US010914465B2

(12) United States Patent
Cohen

(10) Patent No.: US 10,914,465 B2
(45) Date of Patent: Feb. 9, 2021

(54) INTEGRATED LIGHTING MODULE

(71) Applicant: Brandon Cohen, Vernon, CA (US)

(72) Inventor: Brandon Cohen, Vernon, CA (US)

( * ) Notice: Subject to any disclaimer, the term of this patent is extended or adjusted under 35 U.S.C. 154(b) by 0 days.

(21) Appl. No.: 16/448,732

(22) Filed: Jun. 21, 2019

(65) Prior Publication Data

US 2020/0378590 A1 Dec. 3, 2020

Related U.S. Application Data

(63) Continuation-in-part of application No. 29/693,575, filed on Jun. 3, 2019.

(51) Int. Cl.

| | |
|---|---|
| ***F21V 29/74*** | (2015.01) |
| ***F21K 9/20*** | (2016.01) |
| ***F21V 7/00*** | (2006.01) |
| ***F21V 15/01*** | (2006.01) |
| ***F21V 29/503*** | (2015.01) |
| ***F21V 19/00*** | (2006.01) |
| ***F21Y 115/10*** | (2016.01) |

(52) U.S. Cl.

CPC ..... *F21V 29/74* (2015.01); *F21K 9/20* (2016.08); *F21V 7/0016* (2013.01); *F21V 15/01* (2013.01); *F21V 19/003* (2013.01); *F21V 19/0015* (2013.01); *F21V 29/503* (2015.01); *F21Y 2115/10* (2016.08)

(58) Field of Classification Search

CPC ..... F21V 29/74; F21V 29/503; F21V 7/0016; F21V 15/01; F21V 19/0015; F21V 19/003; F21K 9/20; F21Y 2115/10

USPC ..... 362/294

See application file for complete search history.

(56) References Cited

U.S. PATENT DOCUMENTS

| | | | | |
|---|---|---|---|---|
| D606,696 | S | 12/2009 | Chen | |
| D640,819 | S | 6/2011 | Pan | |
| D656,263 | S | 3/2012 | Ogawa | |
| D668,372 | S | 10/2012 | Renshaw | |
| 8,408,759 | B1 * | 4/2013 | Rashidi | F21S 8/026 362/373 |
| D682,459 | S | 5/2013 | Gordin | |
| D694,456 | S | 11/2013 | Rowlette, Jr. | |

(Continued)

OTHER PUBLICATIONS

SORAA LED Optical Light Engine See: https://res.cloudinary.com/soraa/image/upload/v1516986148/resources/misc/ole-more-info-pdf.pdf.

(Continued)

*Primary Examiner* — Andrew J Coughlin
*Assistant Examiner* — Jessica M Apenteng
(74) *Attorney, Agent, or Firm* — Eric Kelly

(57) ABSTRACT

An integrated lighting module may have a driver cap, a heat sink module, a LED light chip, an optical reflector, and a holder. The driver cap may be configured to hold a driver within the driver cap to power the LED light chip. The driver cap may attach to a top of the heat sink module. The heat sink module may be finned at its upper portions, the heat sink module may have a larger diameter than a non-finned bottom portion. The holder may screw upon the bottom portion of the heat sink module with the optical reflector and the LED light chip disposed between the holder and the heat sink module. Trim, such as MR16 sized trim, a lamp, and/or a lens holder, may attach to bottom flanges of the holder. The integrated lighting module may be adjusted without interfering with the trim.

19 Claims, 13 Drawing Sheets

(56) References Cited

U.S. PATENT DOCUMENTS

| | | | | |
|---|---|---|---|---|
| D708,381 | S | 7/2014 | Rashidi | |
| D714,989 | S | 10/2014 | Rowlette, Jr. | |
| D726,949 | S | 4/2015 | Redfern | |
| D734,525 | S | 7/2015 | Gordin | |
| D777,967 | S | 1/2017 | Redfern | |
| D779,100 | S | 2/2017 | Redfern | |
| D790,102 | S | 6/2017 | Guzzini | |
| D820,494 | S | 6/2018 | Cohen | |
| 2019/0242552 | A1* | 8/2019 | Liu | F21V 5/02 |

OTHER PUBLICATIONS

DMF DRD2 Product Publicly available at least as early as Sep. 6, 2018 Website: https://www.dmflighting.com/product/drd2/.

DMF DRD4 Product Publicly available at least as early as Sep. 6, 2018 Website: https://www.dmflighting.com/product/drd4/.

ELCO E247 Product Publicly available at least as early as Sep. 6, 2018 See attached concurrently filed NPL document with two product images of this ELCO E247 Product.

SORAA LED Optical Light Engine Bee: https://res.cloudinary.com/soraa/image/upload/v1516986148/resources/misc/ole-more-info-pdf.pdf.

NORA Lighting Product: NIOB-2RNDC Publicly available at least as early as Oct. 8, 2020 Website: https://noralighting.com/product/niob-2rndc/.

NORA Lighting Product: NIO-4RPH Publicly available at least as early as Oct. 8, 2020 Website: https://noralighting.com/product/nio-4rph/.

NORA Lighting Product: NIOB-1RNG Publicly available at least as early as Oct. 8, 2020 Website: https://noralighting.com/product/niob-1rng/.

* cited by examiner

INTEGRATED LIGHTING MODULE

PRIORITY NOTICE

The present patent application is a continuation-in-part (CIP) of U.S. non-provisional patent application Ser. No. 29/693,575 filed on Jun. 3, 2019, and claims priority to said U.S. non-provisional patent application under 35 U.S.C. § 120. The above-identified patent application is incorporated herein by reference in its entirety as if fully set forth below.

TECHNICAL FIELD OF THE INVENTION

The present invention relates in general to integrated lighting modules and more specifically to an integrated lighting module wherein its heat sink module may have an upper portion that is finned and a bottom portion that is non-finned, wherein a diameter of the upper finned portion may be larger than a diameter of the bottom non-finned portion.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

There is a need in the art for an integrated lighting module that has a heat sink module with an upper finned portion and bottom non-finned portion, wherein a diameter of the upper finned portion is larger than a diameter of bottom non-finned portion as this will allow for increased heat dissipation efficiencies, increased lumens output, while still be configured for a specific sized trim, such as, but not limited, to MR16 sized trim.

There is a need in the art for an integrated lighting module that may be adjusted without interfering with its associated trim.

It is to these ends that the present invention has been developed.

BRIEF SUMMARY OF THE INVENTION

To minimize the limitations in the prior art, and to minimize other limitations that will be apparent upon reading and understanding the present specification, the present invention may describe an integrated lighting module and/or a lighting system that comprises the integrated lighting module.

In some embodiments, the integrated lighting module may have a driver cap, a finned heat sink module, a LED light chip, an optical reflector, and a holder. In some embodiments, the driver cap may be configured to hold a driver within the driver cap to power the LED light chip. In some embodiments, the driver cap may attach to a top of the heat sink module. In some embodiments, where the heat sink module may be finned at its upper portions, the heat sink module may have a larger diameter than its non-finned bottom portion, which in turn may provide for increased heat dissipation and greater lumens output. In some embodiments, the holder may screw upon the bottom portion of the heat sink module with the optical reflector and the LED light chip disposed between the holder and the heat sink module. In some embodiments, trim, such as MR16 sized trim, may attach to bottom flanges of the holder. In some embodiments, the integrated lighting module may be adjusted without interfering with the trim.

It is an objective of the present invention to provide an integrated lighting module.

It is another objective of the present invention to provide an integrated lighting module wherein its heat sink module may have an upper portion that is finned and a lower/bottom portion that is non-finned, wherein a diameter of the upper finned portion may be larger than a diameter of the bottom non-finned portion.

It is another objective of the present invention to provide an integrated lighting module wherein its heat sink module that may be used with MR16 sized trim, a lamp holder, and/or a lens holder.

It is yet another objective of the present invention to provide an integrated lighting module wherein its heat sink module that may be adjusted without interfering with the trim.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1:
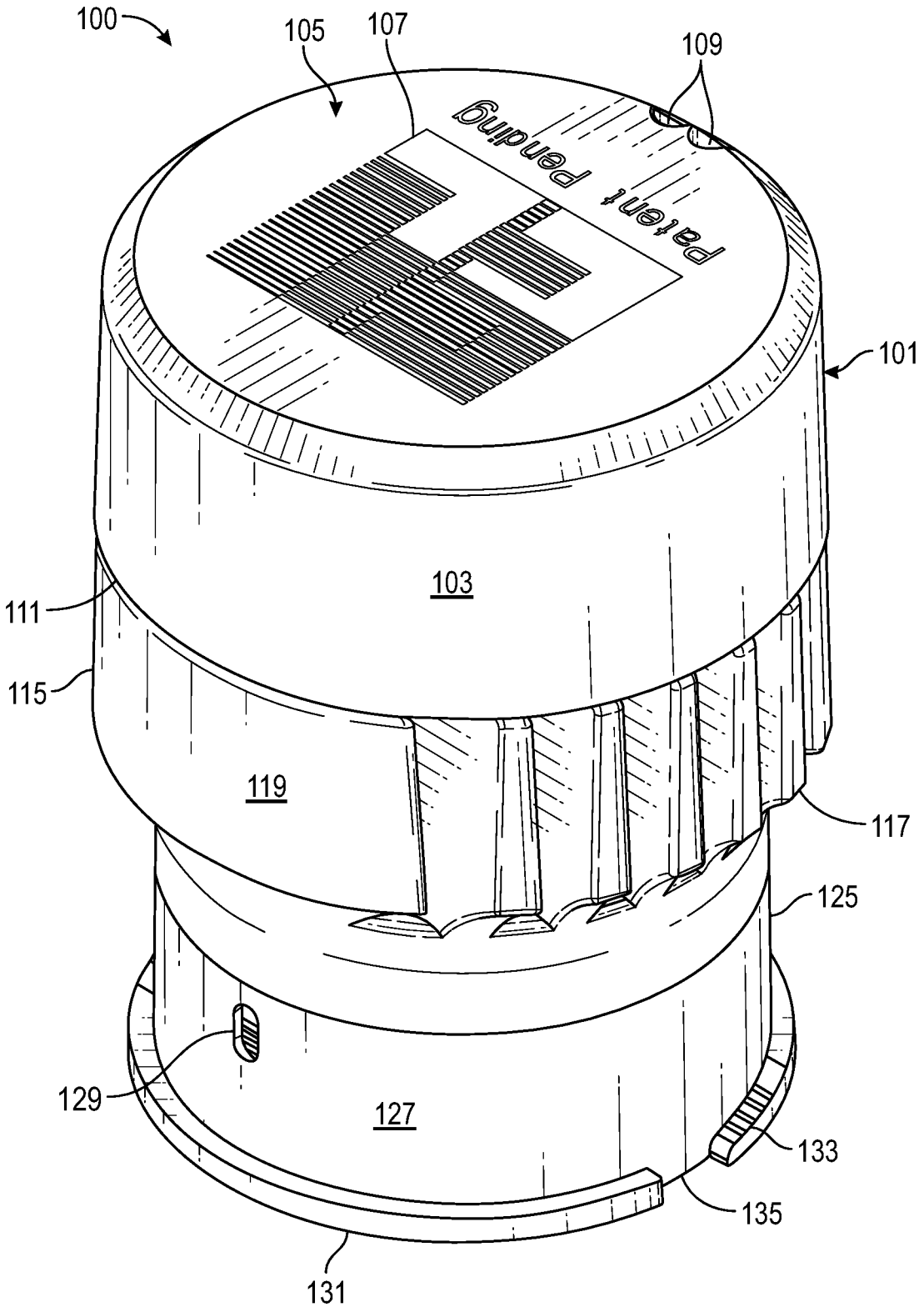
FIG. 1 illustrates a top perspective view of an integrated lighting module (in an assembled configuration).

100 integrated-lighting-module 100
101 driver cap 101
103 side-wall 103 (first side-wall 103)
105 top 105 (first top 105)
107 indicator 107
109 aperture 109
111 bottom 111 (first bottom 111)
115 heat sink module 115
117 fin 117
119 side wall 119
701 LED light chip 701
703 optical reflector 703
125 holder 125
127 side-wall 127 (second side-wall 127)
129 thread lock notch 129
131 twist-lock-flange 131
133 twist-lock-teeth 133
135 twist-lock-opening 135
901 heat-sink-module-top-diameter 901
903 holder-side-wall-diameter 903
905 twist-lock-flange-outer-diameter 905
907 assembled-integrated-lighting-module-length 907
909 assembled-holder-length 909
911 assembled-driver-cap-and-heat-sink-module-length 911
1001 fin-radius 1003
1003 flange-radius 1003
1115 top 1115 (second top 1115)
1117 aperture 1117 (of heat sink 115)
1119 aperture 1119 (of heat sink 115)
1121 aperture 1121 (of heat sink 115)
1123 threading 1123 (of heat sink 115)
1125 bottom 1125 (of heat sink 115)
1131 top-hole 1131 (of optical reflector 703)
1133 bottom 1133 (second bottom 1133)
1141 top 1141 (third top 1141)
1143 internal-threading 1143 (of holder 125)
1201 frame 1201
1203 frame hole 1203
1211 can 1211
1221 trim 1221
1299 full assembly 1299

DETAILED DESCRIPTION OF THE INVENTION

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

FIG. 1 illustrates a top perspective view of an integrated lighting module 100 (in an assembled configuration). Note, unless otherwise specified "integrated lighting module 100" may refer to the assembled configuration for integrated lighting module 100 such as that shown in FIG. 1. In some embodiments, integrated lighting module 100 may also be known as a driver assembly. In some embodiments, integrated lighting module 100 may comprise sub-components of a driver cap 101, a heat sink module 115, and a holder 125. In some embodiments, driver cap 101 may attach to a top portion of heat sink module 115 (and in some embodiments, this attachment may be removable). In some embodiments, a bottom portion of heat sink module 115 may attach to holder 125 (and in some embodiments, this attachment may be removable). In some embodiments, heat sink module 115 may be disposed between driver cap 101 and holder 125. In some embodiments, heat sink module 115 may be in communication with driver cap 101 and with holder 125. In some embodiments, driver cap 101 may not be touching holder 125.

Continuing discussing FIG. 1, in some embodiments, driver cap 101 may be substantially hollow (void space) and cylindrical member (e.g., with side-wall 103) that may be closed (capped) at one end (its top 105) and open at its other end (bottom 111). In some embodiments, this hollow void space that driver cap 101 may surround may be for various electronics, such as, but not limited to a driver. In some embodiments, top 105 and bottom 111 of driver cap 101 may be disposed opposite from each other, separated by side-wall 103. In some embodiments, top 105 may comprise one or more aperture(s) 109. In some embodiments, top 105 may have one or more aperture(s) 109. In some embodiments, the one or more aperture(s) 109 may be through holes. In some embodiments, the one or more aperture(s) 109 may facilitate passage of wires, cabling, and/or the like. In some embodiments, top 105 may have one or more indicator(s) 107. In some embodiments, top 105 may have one or more indicator(s) 107. In some embodiments, the one or more indicator(s) 107 may be one or more of: words, numbers, graphics, logos, trademarks, serial numbers, model numbers, certification indications, status indications, and/or the like. In some embodiments, bottom 111 of driver cap 101 may be open, which may allow various electronics, such as, but not limited to, the driver to be inserted and used while in the hollow void space that driver cap 101 may surround. In some embodiments, bottom 111 of driver cap 101 may be open, which may allow driver cap 101 to attach (removably so in some embodiments) to a top portion of heat sink module 115. In some embodiments, a nature (type or style) of attachment between driver cap 101 and heat sink module 115 may be one or more of: friction fit, press fit, snap fit, threaded fit, attached using adhesives, welded fit, attached using screws, attached using bolts, attached using tacks, and/or the like.

Continuing discussing FIG. 1, in some embodiments, heat sink module 115 may be a substantially hollow (surrounding void space) and cylindrical member that may be substantially finned along its upper (top) portion and threaded along its bottom portion. In some embodiments, heat sink module 115 may be finned with a plurality of fins 117. In some embodiments, heat sink module 115 may be fined (e.g., with fin(s) 117) or non-finned (e.g., no fins 117). In some embodiments, heat sink module 115 may be finned with one or more fin(s) 117. In some embodiments, the one or more fin(s) 117 may encourage, facilitate, and/or provide for heat transfer, such as, but not limited, heat radiated out from these one or more fin(s) 117 into the surrounding environment. In some embodiments, the one or more fin(s) 117 may allow cooling of heat sink module 115. In some embodiments, where sides of heat sink module 115 are not finned with fins 117, there may be side walls 119. In some embodiments, heat sink module 115 may comprise side walls 119. In some embodiments, heat sink module 115 may have side walls 119. In some embodiments, heat sink module 115 may house various electronics, such as, but not limited to, LED light chip 701 (see e.g., FIG. 7 and FIG. 11 for LED light chip 701). Note, "LED" as used herein may mean "light emitting diode." In some embodiments, heat sink module 115 may house at least some portion of optical reflector 703 (see e.g., FIG. 7 and FIG. 11 for optical reflector 703). In some embodiments, heat sink module 115 may be substantially (mostly) closed at its top end (aside from various apertures and the fins 117). In some embodiments, heat sink module 115 may be substantially (mostly) open at its bottom end.

In some embodiments, heat sink module 115 may attach to holder 125. In some embodiments, heat sink module 115 may be removably attached to holder 125. In some embodiments, heat sink module 115 may be removably attached to holder 125 via complimentary threading on each respective component (such as, threading 1123 of heat sink module 115 and internal-threading 1143 of holder 125—see e.g., FIG. 11).

Continuing discussing FIG. 1, in some embodiments, holder 125 may be a substantially hollow and cylindrical member that may be open at both ends. In some embodiments, holder 125 may hold heat sink module 115. In some embodiments, holder 125 may hold optical reflector 703. In some embodiments, holder 125 may hold both heat sink module 115 and optical reflector 703. In some embodiments, when integrated-lighting-module 100 may be assembled, at least a portion of heat sink module 115 and/or at least a portion of optical reflector 703 may be located within holder 125. In some embodiments, a main cylindrical side wall portion of holder 125 may be denoted as side-wall 127. In some embodiments, holder 125 may comprise side-wall 127, which may be a side wall of holder 125. In some embodiments, within side-wall 127 may be one or more holes, denoted as thread lock notch 129. In some embodiments, a given thread lock notch 129 may be a through hole through side-wall 127. In some embodiments, a given thread lock notch 129 may be threaded to receive a threaded screw and/or a threaded bolt. In some embodiments, such a threaded screw and/or a threaded bolt passing through thread lock notch 129, may be used to securely lock optical reflector 703 onto a bottom portion of heat sink module 115.

Continuing discussing FIG. 1, in some embodiments, a bottom portion of holder 125 may have a twist-lock flange 131. In some embodiments, twist-lock flange 131 may be one or more flange(s) that run around and extend outwardly from a bottom portion of holder 125.

In some embodiments, twist-lock flange 131 may be two or more flange(s) that run around and extend outwardly from a bottom portion of holder 125; wherein each such flange may be separated by a gap in the given flange, wherein this gap may be denoted as twist-lock-opening 135. In some embodiments, at one end of each such gap (i.e., at one end of twistlock-opening 135) may be a tapered portion of twist-lock flange 131 with gripping teeth, denoted as twist-lock-teeth 133. In some embodiments, the two or more twist-lock flanges 131, with two twist-lock-teeth 133, and two twist-lock-openings 135, may be used to removably attached holder 125 to a given trim 1221 (see e.g., FIG. 12A and FIG. 12B for trim 1221).

In some embodiments, optical reflector 703 may be held (secured) by holder 125. In some embodiments, optical reflector 703 may be held within holder 125. In some embodiments, this may be accomplished by a set screw passing at least partially through a given thread lock notch 129 of holder 125 to engage optical reflector 703. In some embodiments, side-wall 127 of holder 125 may have at least one thread lock notch 129. See e.g., FIG. 1.

In some embodiments, holder 125 may be removed via twisting (un-twisting) action, which in turn may then allow for a change in optics (such as, but not limited, to use of louvers, spread lens, and/or the like). In some embodiments, holder 125 may have adjustability via twisting (or un-twisting) action. In some embodiments, adjusting holder 125 may not require tools.

In some embodiments, a given integrated lighting module 100 may comprise: a driver cap 101, a heat sink module 115, a LED light chip 701, an optical reflector 703, and a holder 125. See e.g., FIG. 1 and FIG. 11.

Figure 2:
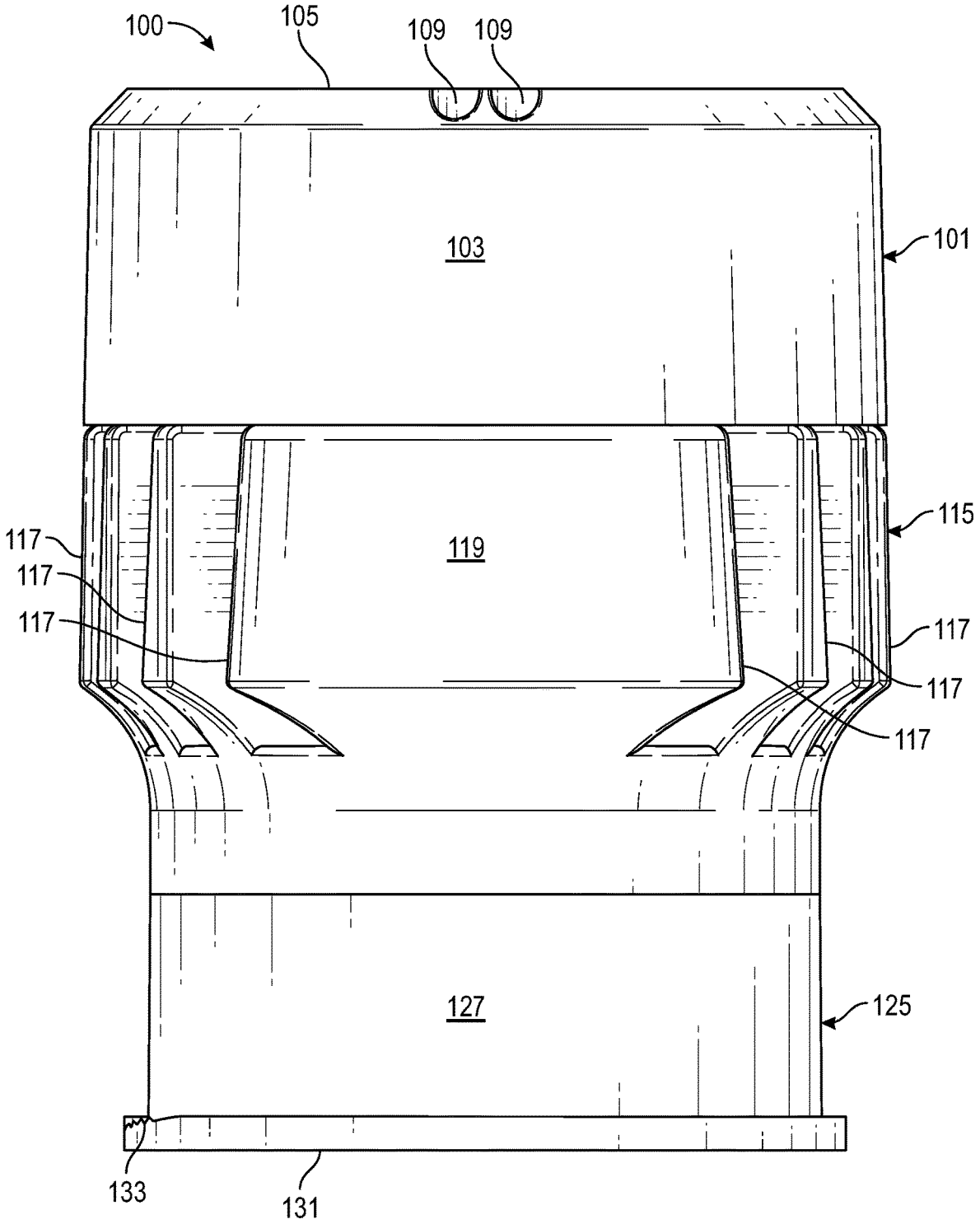
FIG. 2 illustrates a front view of the integrated lighting module of FIG. 1.

FIG. 2 illustrates a front view of integrated lighting module 100. Portions of driver cap 101, of heat sink module 115, and of holder 125 of integrated lighting module 100 may be seen in FIG. 2. Portions of aperture(s) 109 of driver cap 101 may be seen. Portions of side-wall 103 of driver cap 101 may be seen. Portions of fins 117 of heat sink module 115 may be seen. Portions of side wall 119 of heat sink module 115 may be seen. Note as shown in FIG. 2, the finned portions of heat sink module 115 may be wider than a bottom portion of heat sink module 115. That is, the bottom of heat sink module 115, where the main opening to the interior of heat sink module 115 may be located, may have a smaller diameter as compared to an upper finned portion of heat sink module 115; and in turn this configuration may facilitate more efficient heat dissipation and/or overall improved performance. For example, and without limiting the scope of the present invention, note in FIG. 2 as the viewer progresses upwards from a bottom of heat sink module 115 that its diameters increases, such that most of the finned region has a greater diameter than the bottom non-finned regions (note, this can also be seen in figures FIG. 3 through FIG. 5). Note, heat sink module 115 may have a curve that transitions from its smaller diameter bottom regions to its upper finned portions with the larger diameter. This curve in heat sink module 115 may permit integrated lighting module 100 to be adjusted without hitting/interfering with trim 1221 (see FIG. 12A or FIG. 12B for trim 1221). (The bottom of heat sink module 115 may be denoted as bottom 1125 and may be shown in FIG. 11.) Portion of side-wall 127 of holder 125 may be seen in FIG. 2. Portions of twistlock-flange 131 and twist-lock-teeth 133 of holder 125 may also be seen in FIG. 2.

Figure 3:
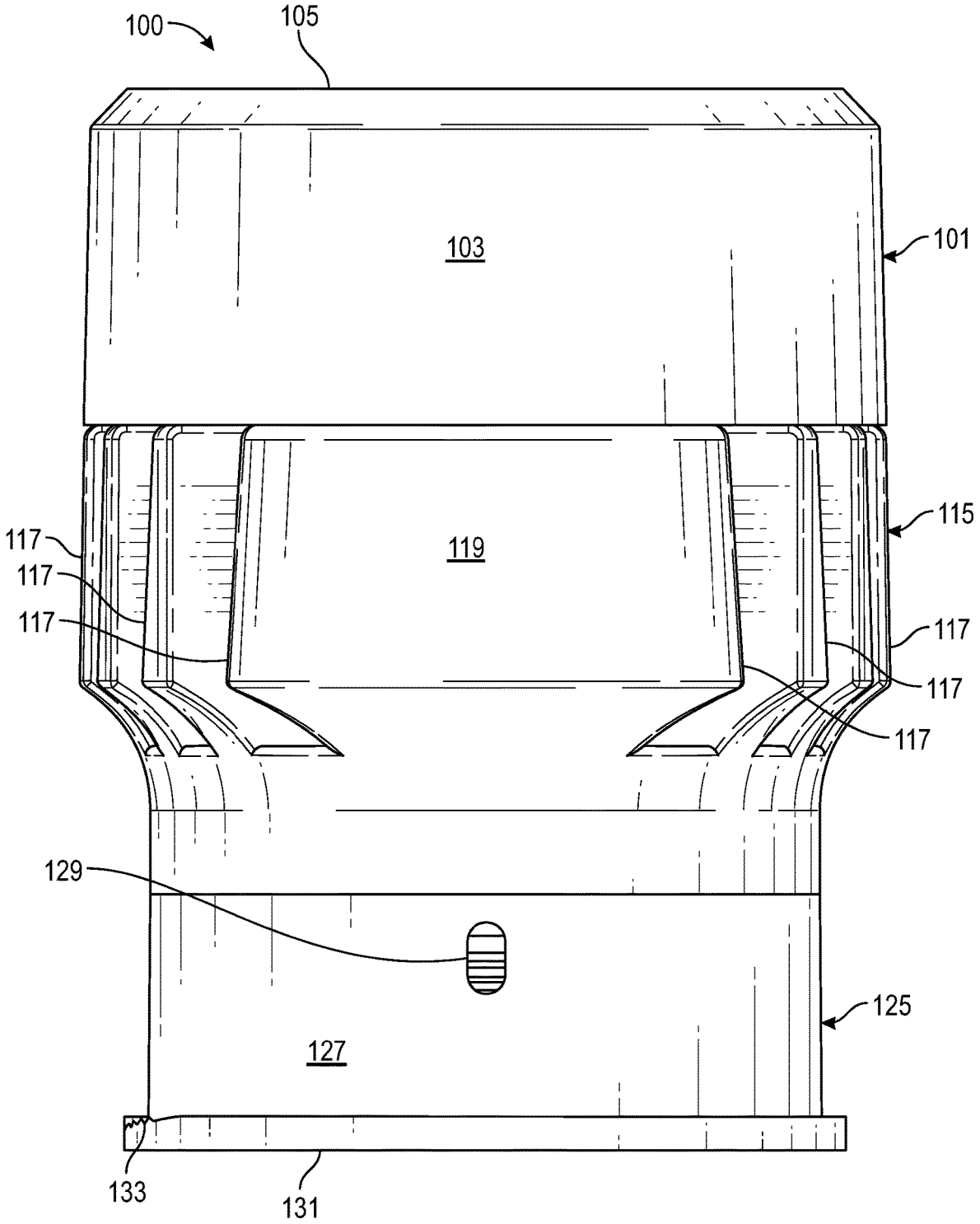
FIG. 3 illustrates a rear view of the integrated lighting module of FIG. 1.

FIG. 3 illustrates a rear view of integrated lighting module 100. Portions of driver cap 101, of heat sink module 115, and of holder 125 of integrated lighting module 100 may be seen in FIG. 3. Portions of side-wall 103 of driver cap 101 may be seen. Portions of fins 117 of heat sink module 115 may be seen. Portions of side wall 119 of heat sink module 115 may be seen. Note as shown in FIG. 3, the finned portions of heat sink module 115 may be wider than a bottom portion of heat sink module 115. That is, the bottom (bottom 1125) of heat sink module 115, where the main opening to the interior of heat sink module 115 may be located, may have a smaller diameter as compared to an upper finned portion of heat sink module 115; and in turn this configuration may facilitate more efficient heat dissipation and/or overall improved performance. (The bottom 1125 of heat sink module 115 may be shown in FIG. 11.) Portion of side-wall 127 of holder 125 may be seen in FIG. 3. A thread lock notch 129 of holder 125 may be seen in FIG. 3. Portions of twist-lock-flange 131 and twist-lock-teeth 133 of holder 125 may also be seen in FIG. 3. The view of FIG. 3 may be an opposing view as compared against the view of FIG. 2.

Figure 4:
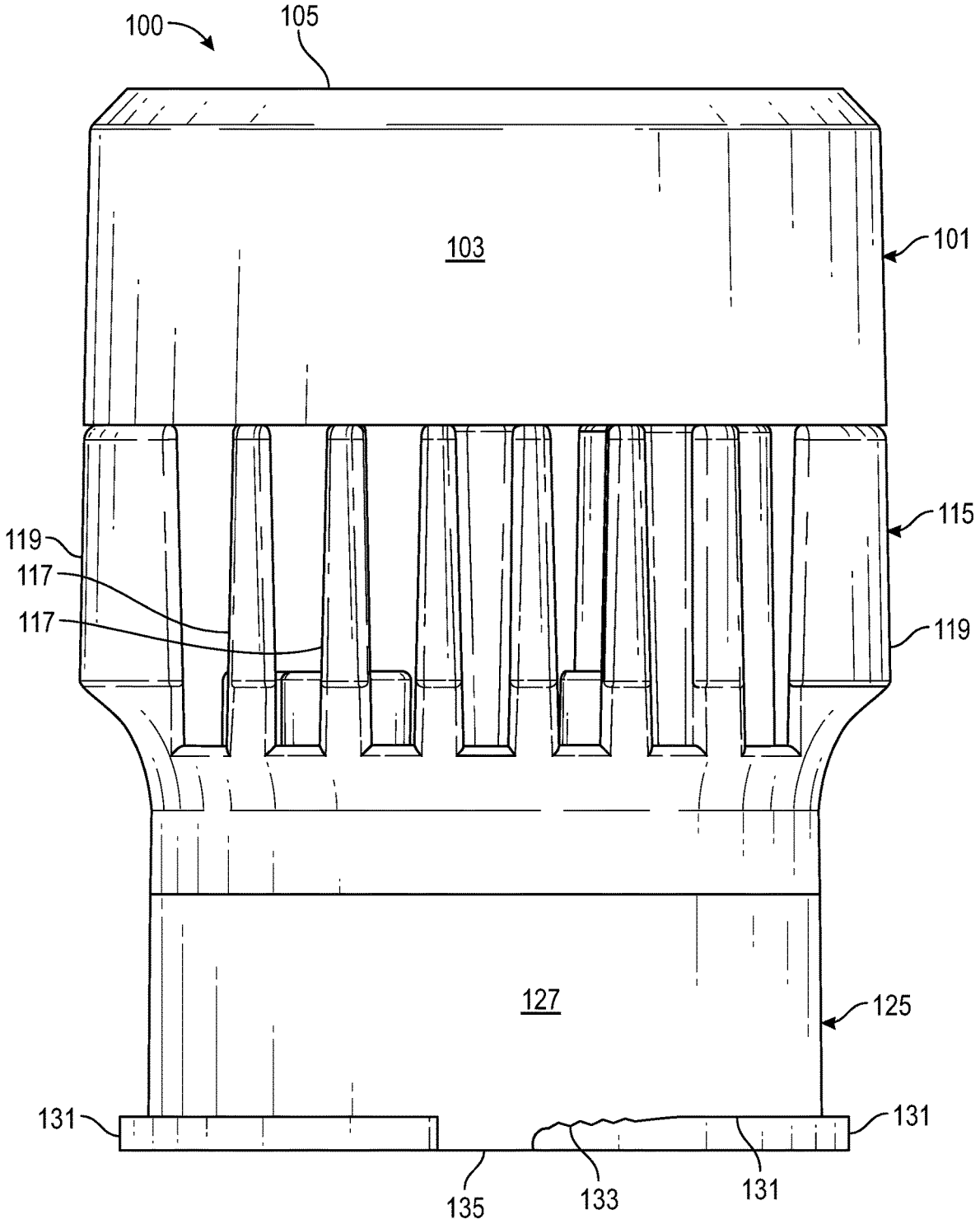
FIG. 4 illustrates a left-side view of the integrated lighting module of FIG. 1.

FIG. 4 illustrates a left-side view of integrated lighting module 100. Portions of driver cap 101, of heat sink module 115, and of holder 125 of integrated lighting module 100 may be seen in FIG. 4. Portions of side-wall 103 of driver cap 101 may be seen. Portions of fins 117 of heat sink module 115 may be seen. Portions of side wall 119 of heat sink module 115 may be seen. Portion of side-wall 127 of holder 125 may be seen in FIG. 4. Portions of twistlock-flange 131 and twist-lock-teeth 133 of holder 125 may also be seen in FIG. 4.

Figure 5:
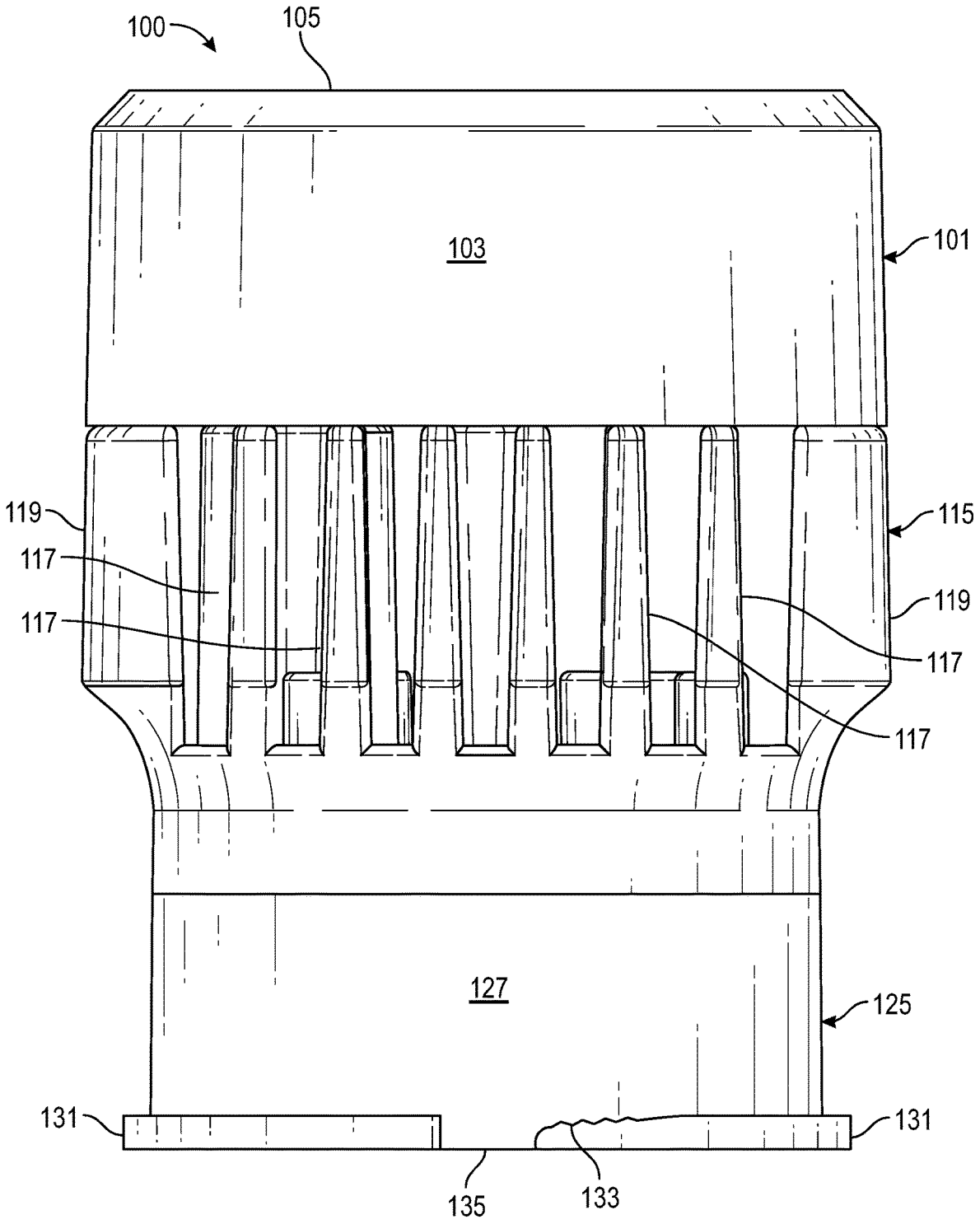
FIG. 5 illustrates a right-side view of the integrated lighting module of FIG. 1.

FIG. 5 illustrates a right-side view of integrated lighting module 100. Portions of driver cap 101, of heat sink module 115, and of holder 125 of integrated lighting module 100 may be seen in FIG. 5. Portions of side-wall 103 of driver cap 101 may be seen. Portions of fins 117 of heat sink module 115 may be seen. Portions of side wall 119 of heat sink module 115 may be seen. Portion of side-wall 127 of holder 125 may be seen in FIG. 5. Portions of twist-lock-flange 131 and twist-lock-teeth 133 of holder 125 may also be seen in FIG. 5. The view of FIG. 5 may be an opposing view as compared against the view of FIG. 4.

Figure 6:
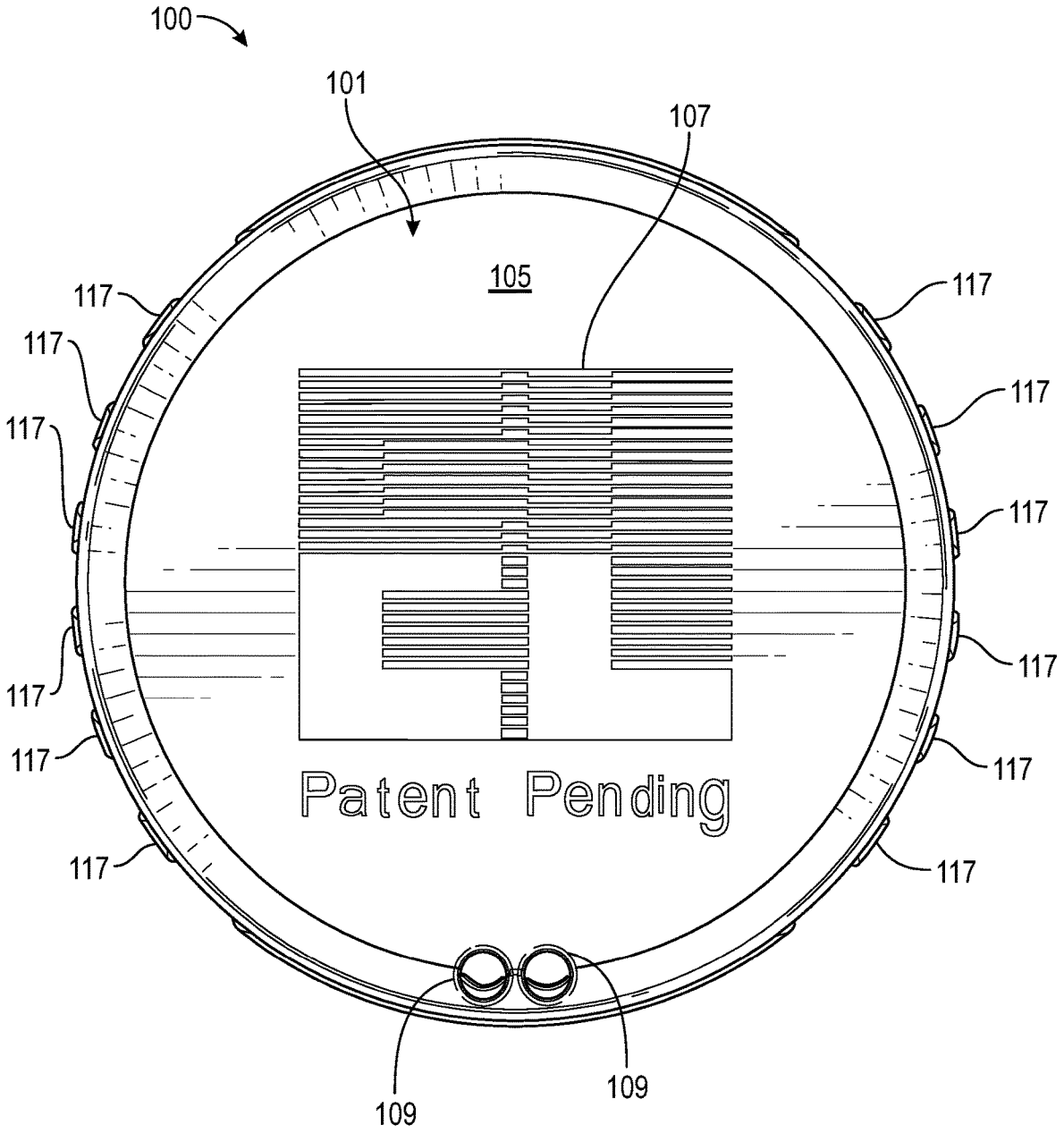
FIG. 6 illustrates a top view of the integrated lighting module of FIG. 1.

FIG. 6 illustrates a top view of integrated lighting module 100. Portions of driver cap 101 and of heat sink module 115 of integrated lighting module 100 may be seen in FIG. 6. Top 105 of driver cap 101 may be seen in FIG. 6. Apertures 109 of driver cap 101 may be seen in FIG. 6. Indicator 107 of driver cap 101 may be seen in FIG. 6. The outer edges of fins 117 of heat sink module 115 may be seen in FIG. 6, being wider (greater in diameter) than driver cap 101 and wider (greater in diameter) than holder 125. The outer edges of side wall 119 of heat sink module 115 may be seen in FIG. 6, being wider (greater in diameter) than driver cap 101 and wider (greater in diameter) than holder 125.

In some embodiments, first top 105 of driver cap 101 may comprise at least one aperture 109. In some embodiments, first top 105 of driver cap 101 may comprise at least one indicator 107. See e.g., FIG. 1 and FIG. 6.

Figure 7:
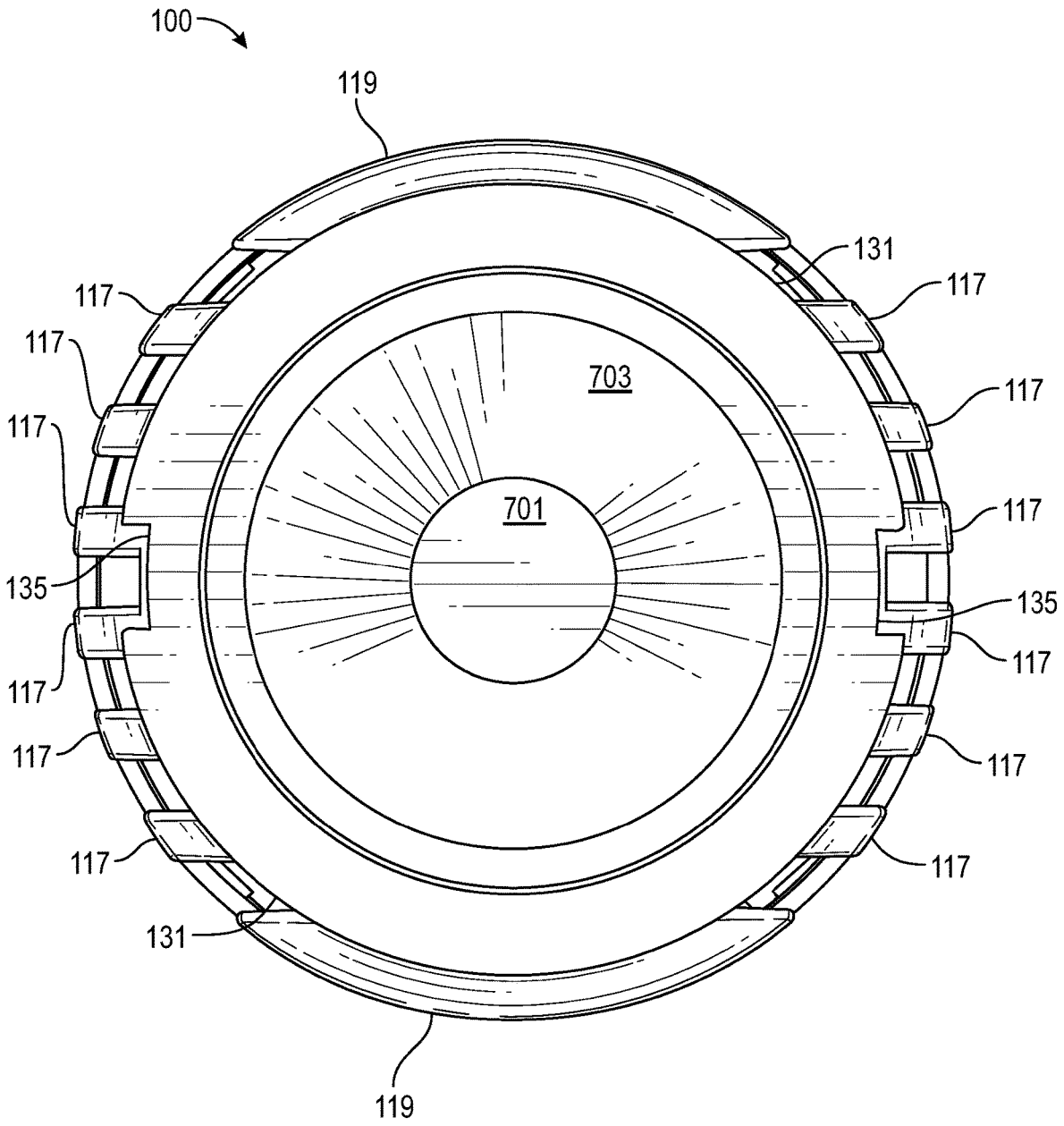
FIG. 7 illustrates a bottom view of the integrated lighting module of FIG. 1.

FIG. 7 illustrates a bottom view of integrated lighting module 100. Portions of holder 125, optical reflector 703, of LED light chip 701, and of heat sink module 115 of integrated lighting module 100 may be seen in FIG. 7. Bottom portions of twist-lock-flanges 131 of holder 125 may be seen in FIG. 7. Bottom portions of twist-lock-openings 135 of holder 125 may be seen in FIG. 7. The two twist-lock-openings 135 may be disposed opposite of each other, separating two different twist-lock-flanges 131. A bottom portion of optical reflector 703 may be seen in FIG. 7. In some embodiments, optical reflector 703 may reflect, direct, distribute, and/or spread out emitted light from LED light chip 701. A top center hole (top-hole 1131) of optical reflector 703 may be where emitted light from LED light chip 701 enters the bottom of optical reflector 703 (see FIG. 11 for top-hole 1131). The outer edges of fins 117 of heat sink module 115 may be seen in FIG. 7, being wider (greater in diameter) than driver cap 101 and wider (greater in diameter) than holder 125. The outer edges of side wall 119 of heat sink module 115 may be seen in FIG. 7, being wider (greater in diameter) than driver cap 101 and wider (greater in diameter) than holder 125. The view of FIG. 7 may be an opposing view as compared against the view of FIG. 6.

Figure 8:
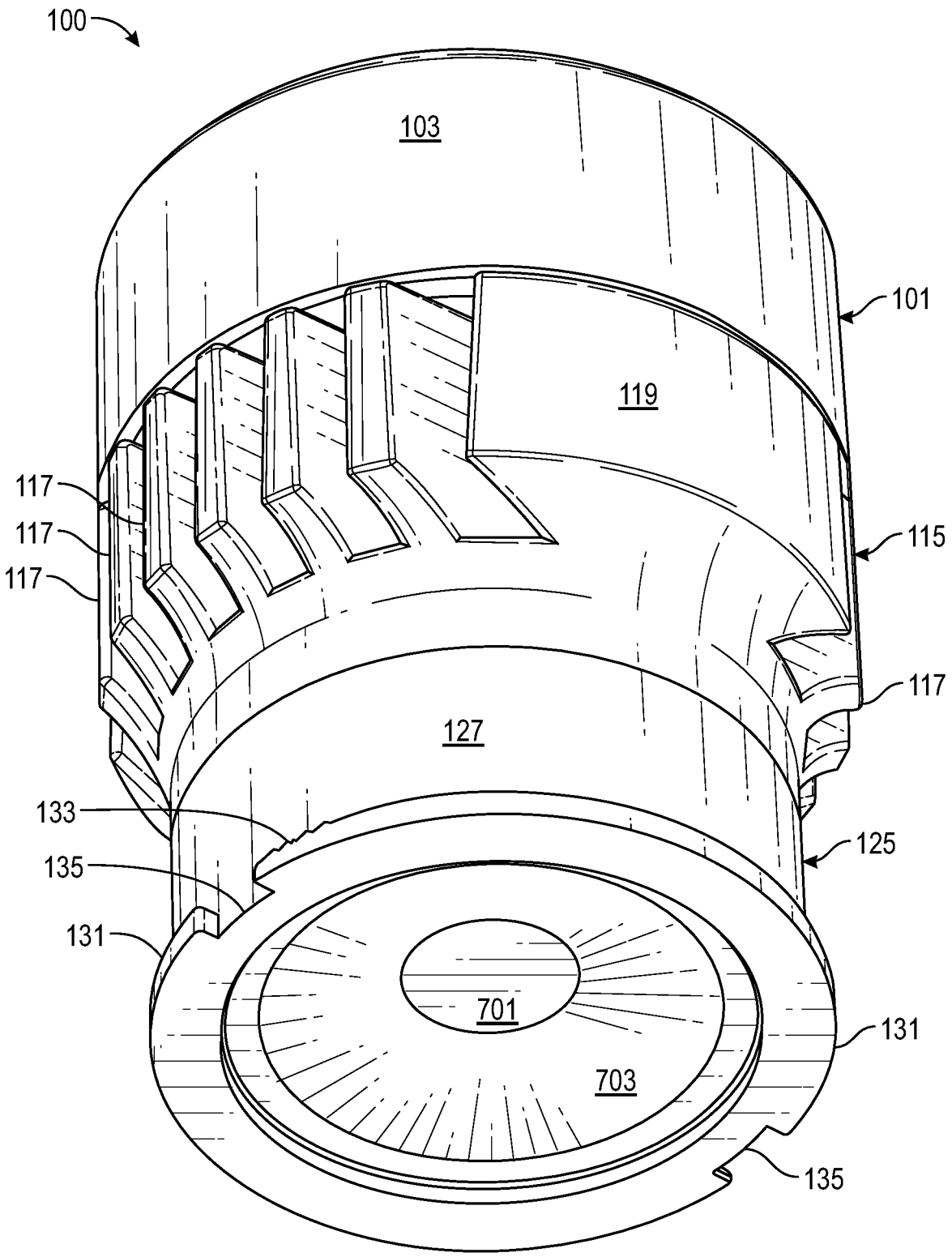
FIG. 8 illustrates a bottom perspective view of the integrated lighting module of FIG. 1.

FIG. 8 illustrates a bottom perspective view of integrated lighting module 100. Portions of driver cap 101, of heat sink module 115, of holder 125, of optical reflector 703, and of LED light chip 101, all of integrated lighting module 100, may be seen in FIG. 8.

Figure 9:
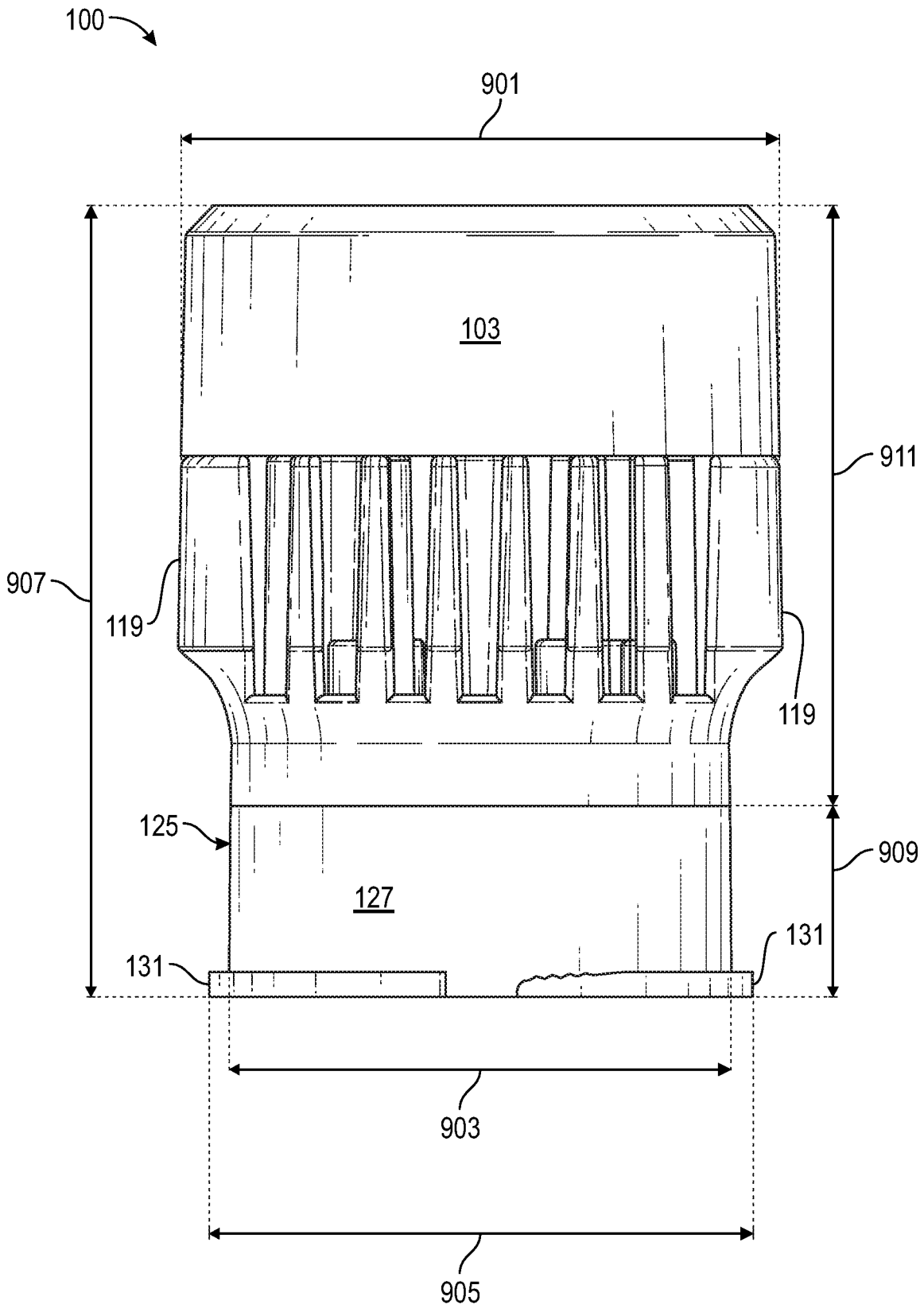
FIG. 9 illustrates the right-side view of the integrated lighting module of FIG. 1 while showing some dimensional relationships of the integrated lighting module.

FIG. 9 illustrates the right-side view of integrated lighting module 100 while showing some dimensional relationships of the integrated lighting module. FIG. 9 may be substantially similar to identical to FIG. 5, except in FIG. 9 various dimensional call-outs and/or relationships may be shown. For example, and without limiting the scope of the present invention the following may be shown in FIG. 9: heat-sink-module-top-diameter 901, twist-lock-flange-outer-diameter 903, holder-side-wall-diameter 905, assembled-integrated-lighting-module-length 907, assembled-holder-length 909, and/or assembled-driver-cap-and-heat-sink-module-length 911.

Continuing discussing FIG. 9, in some embodiments, heat-sink-module-top-diameter 901 may be an outer (outside) diameter of heat-sink-module 115 as measured near a top of heat sink module 115. In some embodiments, heat-sink-module-top-diameter 901 may be 55.65 mm (millimeters), plus or minus 5 mm. (In some embodiments, 55.65 mm may be about 2.19 inches.) In some embodiments, holder-side-wall-diameter 903 may be an outer (outside) diameter of holder 125 as measured at side-wall 127 of holder 125. In some embodiments, holder-side-wall-diameter 903 may be 45.80 mm, plus or minus 5 mm. (45.80 mm may be about 1.80 inches.) In some embodiments, twist-lock-flange-outer-diameter 905 may be an outer (outside) diameter across twist-lock-flange 131 of holder 125. In some embodiments, twistlock-flange-outer-diameter 905 may be 49.98 mm, plus or minus 5 mm. (49.98 mm may be about 1.97 inches.) In some embodiments, assembled-integrated-lighting-module-length 907 may be an overall length (height) of integrated-lighting-module 100, when integrated-lighting-module 100 may be in its assembled configuration. In some embodiments, assembled-integrated-lighting-module-length 907 may be 72.70 mm, plus or minus 5 mm. In some embodiments, assembled-holder-length 909 may be a length of holder 125, when holder 125 may be assembled into a given integrated-lighting-module 100 from a bottom of holder 125 towards its top (top 1141 shown in FIG. 11). In some embodiments, assembled-driver-cap-and-heat-sink-module-length 911 may be length from top 105 of driver cap 101 towards a bottom portion of heat sink module 115, below fins 117, when driver cap 101 and heat sink module 115 may be assembled into a given integrated-lighting-module 100. In some embodiments, heat-sink-module-top-diameter 901 may be greater than holder-side-wall-diameter 903; which may facilitate improved heat dissipation efficiency and/or overall improved performance. In some embodiments, a ratio of heat-sink-module-top-diameter 901 to holder-side-wall-diameter 903 may be greater than one up to and including 1.5. For example, and without limiting the scope of the present invention, a ratio of heat-sink-module-top-diameter 901 to holder-side-wall-diameter 903 may be from 1.21 to 1.22.

Figure 10:
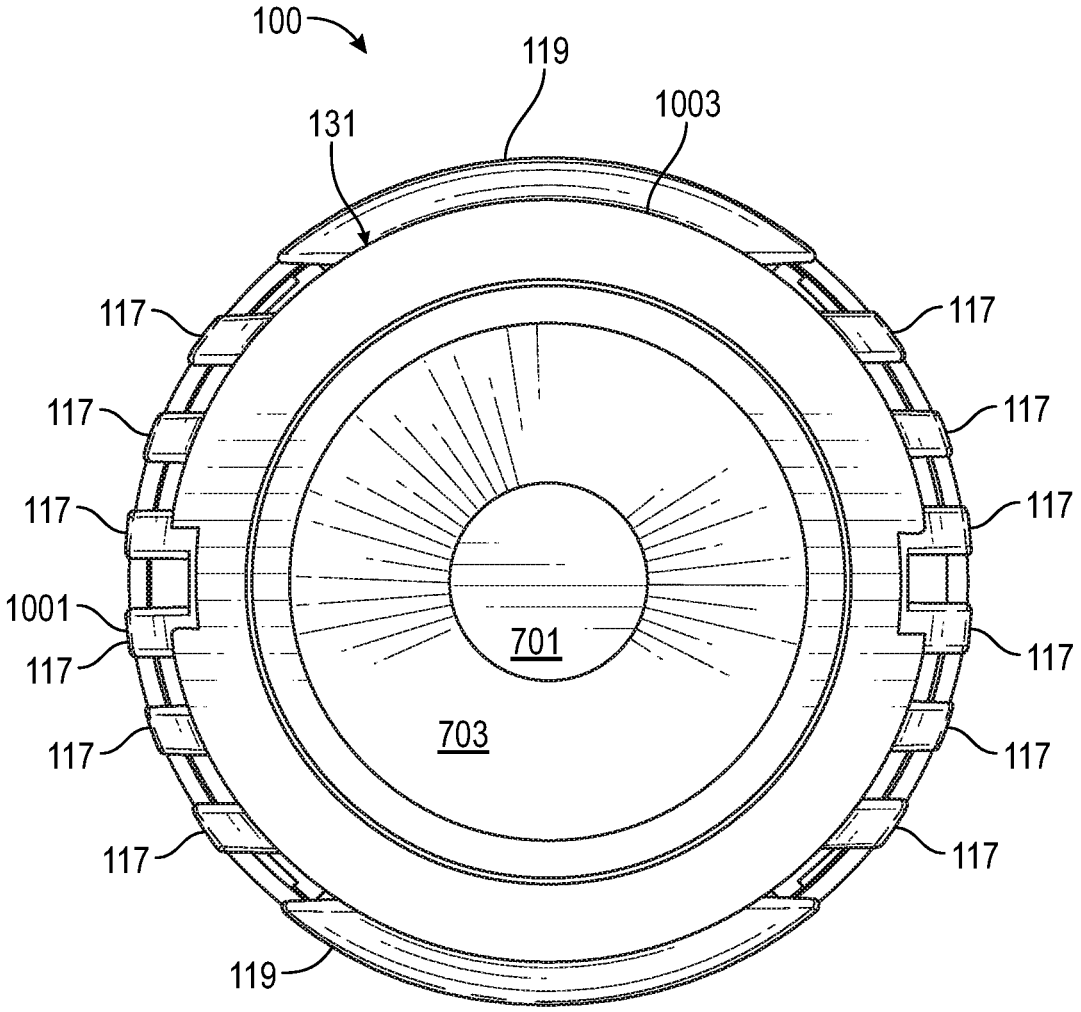
FIG. 10 illustrates the bottom view of the integrated lighting module of FIG. 1 while showing some dimensional relationships (e.g., radii) of the integrated lighting module.

FIG. 10 illustrates the bottom view of integrated lighting module 100 while showing some dimensional relationships (e.g., radii) of the integrated lighting module. FIG. 10 may be substantially similar to FIG. 7, except in FIG. 10 two radius may be called out, fin-radius 1001 and flange-radius 1003. In some embodiments, fin-radius 1001 may be a radius as measured from out an outer fin 117 surface to a center of integrated lighting module 100; wherein the center is the center of the view of the figure shown in FIG. 10. In some embodiments, fin-radius 1001 may be 27.83 mm, plus or minus 2.5 mm. In some embodiments, flange-radius 1003 may be a radius from an outside edge of twist-lock-flange 131 to this center. In some embodiments, flange-radius 1003 may be 24.99 mm, plus or minus 2.5 mm.

In some embodiments, other dimensions for heat-sink-module-top-diameter 901, holder-side-wall-diameter 903, twist-lock-flange-outer-diameter 905, assembled-integrated-lighting-module-length 907, assembled-holder-length 909, assembled-driver-cap-and-heat-sink-module-length 911, fin-radius 1001, and/or flange-radius 1003 are contemplated. In some embodiments, dimensions for heat-sink-module-top-diameter 901, holder-side-wall-diameter 903, twist-lock-flange-outer-diameter 905, assembled-integrated-lighting-module-length 907, assembled-holder-length 909, assembled-driver-cap-and-heat-sink-module-length 911, fin-radius 1001, and/or flange-radius 1003 may be fixed and predetermined.

Figure 11:
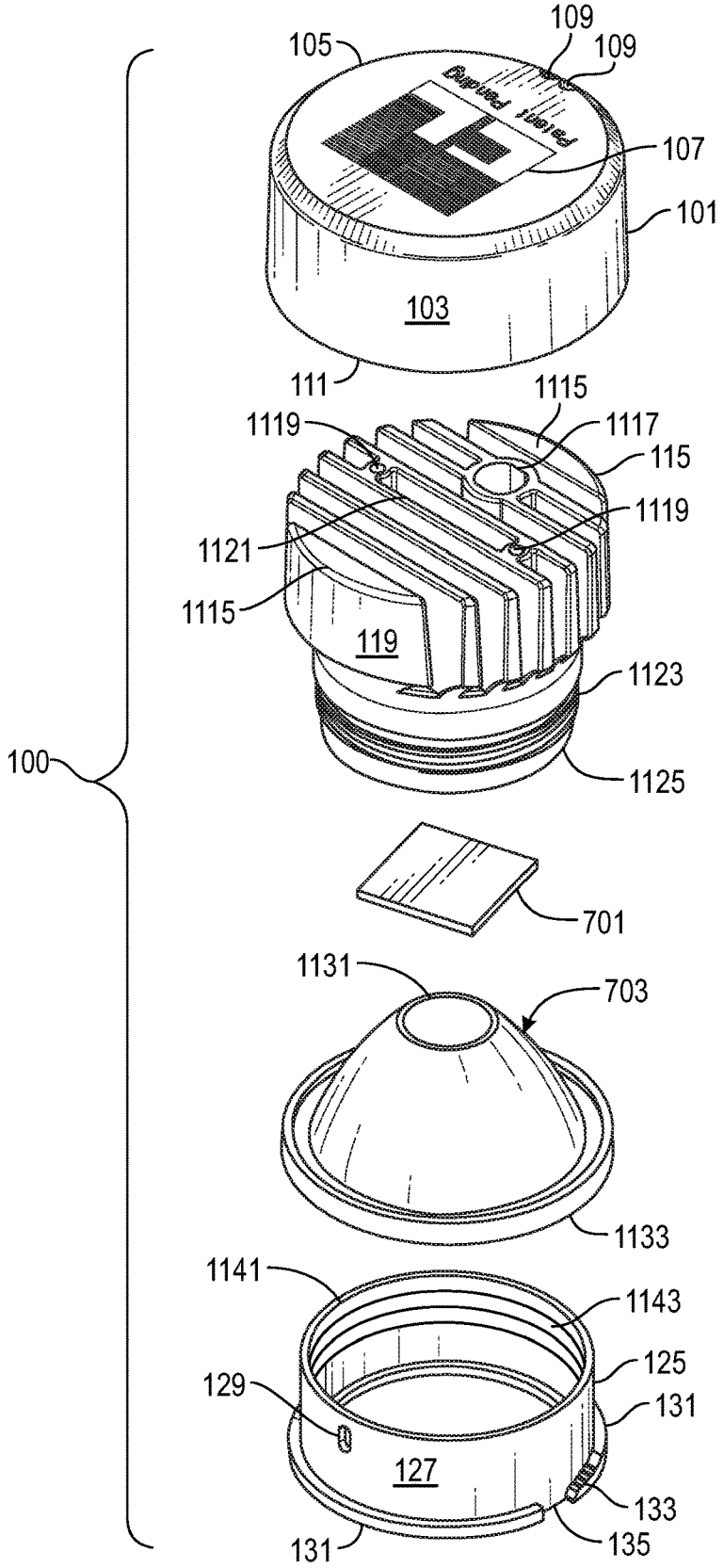
FIG. 11 illustrates an exploded top perspective view of the integrated lighting module of FIG. 1.

FIG. 11 illustrates an exploded top perspective view of integrated lighting module 100. FIG. 11 may show main sub-components separated from each other of integrated lighting module 100. FIG. 11 may show driver cap 101 separated from heat sink module 115. FIG. 11 may show heat sink module 115 separated from: LED light chip 701 (that may emit light), optical reflector 703, and holder 125.

Continuing discussing FIG. 11, in some embodiments, the substantially cylindrically shaped heat sink module 115 may have a top 1115 and a bottom 1125. In some embodiments, top 1115 may be disposed opposite from bottom 1125. In some embodiments, in top 1115 may be various holes and/or apertures, such as, but not limited to, aperture 1117, aperture(s) 1119, and/or aperture 1121. In some embodiments, apertures in top 1115, may be for receiving screws, bolts, wiring, cabling, and/or at least portions of electronic components. In some embodiments, aperture 1117, aperture(s) 1119, and/or aperture 1121 may be for receiving screws, bolts, wiring, cabling, and/or at least portions of electronic components. In some embodiments, at least one fin 117 may run substantially linearly (straight) across top 1115. In some embodiments, at least one fin 117 may run substantially linearly (straight) across top 1115, except where interrupted by an aperture (e.g., aperture 1117, aperture(s) 1119, and/or aperture 1121) and where two opposing regions of side wall 119 may descend from top 1115. In some embodiments, at least two fins 117 may run substantially parallel across top 1115. In some embodiments, at least two fins 117 may run substantially parallel across top 1115, except where interrupted by an aperture (e.g., aperture 1117, aperture(s) 1119, and/or aperture 1121) and where two opposing regions of side wall 119 may descend from top 1115. In some embodiments, the finned regions (of fins 117) of heat sink module 115, may occupy the majority of the upper portions of heat sink module 115. In some embodiments, bottom portions of heat sink module 115 may have no fins 117. In some embodiments, the upper finned regions of heat sink module 115 may have a greater diameter (e.g., heat-sink-module-top-diameter 901) than the none finned bottom portions of heat sink module 115 (e.g., hear or proximate to holder-side-wall-diameter 903). In some embodiments, a bottom portion of heat sink module 115 may have threading 1123. In some embodiments, threading 1123 may permit removable attachment of heat sink module 115 to optical reflector 703. In some embodiments, threading 1123 may permit removable attachment of heat sink module 115 to holder 125. In some embodiments, threading 1123 may wrap entirely around the bottom portion(s) of heat sink module 115.

Continuing discussing FIG. 11, in some embodiments, optical reflector 703 have a top (at top-hole 1131) and a bottom 1133, wherein the top may be disposed away from the bottom 1133. In some embodiments, 703 may be substantially conical in space, but without a cone's point; instead, a cone's point might reside may be replaced with top-hole 1131. In some embodiments, top-hole 1131 may permit at least some light emitted from LED light chip 701 to enter the underside (bottom) of optical reflector 703. In some embodiments, LED light chip 701 may be mounted at or proximate (near/adjacent) to top-hole 1131. In some embodiments, the underside (bottom) of optical reflector 703 may be substantially reflective and/or shiny, to facilitate reflecting at least some light out through bottom 1133, which may be substantially open. In some embodiments, optical reflector 703 may help to reflect, direct, distribute, and/or spread out at least some emitted light from LED light chip 701.

Continuing discussing FIG. 11, in some embodiments, a top 1141 of the substantially cylindrically shaped and hollow holder 125 may be shown. At least some interior surfaces of holder 125 may be seen in FIG. 11. In some embodiments, at least some portions of the interior surfaces of holder 125 may comprise internal-threading 1143. In some embodiments, 1143 may be complimentary to threading 1123 of heat sink module 115. In some embodiments, heat sink module 115 may be removably attached to holder 125. In some embodiments, threading 1123 of heat sink module 115 may be removably and complimentary threaded onto internal-threading 1143 of holder 125. In some embodiments, threading 1123 of heat sink module 115 may removably and complimentary thread onto thread lock notches 129 of holder 125.

In some embodiments, a given integrated lighting module 100 may comprise: a driver cap 101, a heat sink module 115, a LED light chip 701, an optical reflector 703, and a holder 125. See e.g., FIG. 11 and FIG. 1.

In some embodiments, driver cap 101 may have first side walls 103, a first top 105 that caps the first side walls 103, and may be open at a first bottom 111. In some embodiments, first side walls 103 and first top 105 may substantially surround a first volume of driver cap 101, wherein the first volume may be configured to receive a driver. This first volume of driver cap 101 may be located beneath first top 105 and within first side walls 103. The driver may power LED light chip 701. See e.g., FIG. 11 and FIG. 1.

In some embodiments, heat sink module 115 may be finned on an upper portion for heat dissipation and heat sink module 115 may be non-finned on a bottom portion. In some embodiments, the upper portion of heat sink module 115 may have a larger diameter than the bottom portion of heat sink module 115. In some embodiments, the bottom portion of heat sink module 115 may curve and transition into the upper portion of heat sink module 115. In some embodiments, first bottom 111 of driver cap 101 may be attachable to a second top 1115, wherein second top 1115 may be top 1115 of heat sink module 115. See e.g., FIG. 11 and FIG. 1.

In some embodiments, the upper portion of heat sink module 115 may be finned with at least two fins 117. In some embodiments, at least two fins 117 may be substantially parallel and run substantially linearly across second top 1115 of heat sink module 115. In some embodiments, second top 1115 of heat sink module 115 may comprise at least one aperture (such as, but not limited to, aperture 1117, aperture 1119, and/or aperture 1121). In some embodiments, the at least one aperture (such as, but not limited to, aperture 1117, aperture 1119, and/or aperture 1121) may interrupt at least one fin 117 of heat sink module 115. In some embodiments, the bottom portion of heat sink module 115 may comprise threading 1123 for removable attachment to holder 125. See e.g., FIG. 11.

In some embodiments, LED light chip 701 may be configured to emit light. In some embodiments, optical reflector 703 may be substantially conical in shape for reflecting and directing at least some light from LED light chip 701 out of a second bottom 1133, wherein the second bottom 1133 is bottom 1133 of optical reflector 703. In some embodiments, LED light chip 701 may be disposed above top-hole 1131 of optical reflector 703 and within heat sink module 115, wherein top-hole 1131 may be located at a top of optical reflector 703. See e.g., FIG. 11 and FIG. 7.

In some embodiments, holder 125 may have second side-walls 127 that may substantially surround a second volume. In some embodiments, this second volume (of holder 125) may be configured to receive at least a portion of the bottom portion of heat sink module 115 (such as, but not limited a portion of heat sink module 115 with threading 1123). In some embodiments, holder 125 may be open at both a third top 1141 and at a third bottom, wherein third top 1141 is top 1141 of holder 125, wherein the third bottom is a bottom of holder 125. See e.g., FIG. 11.

In some embodiments, the third bottom of holder 125 may comprise two twist-lock-flanges 131 that may be configured for removable attachment to trim 1221, wherein each of the two twist-lock-flanges 131 is a flange. In some embodiments, the two twist-lock-flanges 131 may be separated from each other by two twist-lock-openings 135 that are breaks between the two twist-lock-flanges 131. In some embodiments, each of the two twist-lock-flanges 131 may begin with twist-lock-teeth 133, wherein the twist-lock-teeth 133 are configured to removably engage at least a portion of trim 1221. See e.g., FIG. 1, FIG. 7, FIG. 11, and FIG. 12A.

In some embodiments, second side-walls 127 of holder 125 may comprise at least one thread lock notch 129 that is a through hole passing through a portion of the second side-walls 127, wherein the at least one thread lock notch 129 is configured to receive at least one screw to secure a portion of optical reflector 703 against heat sink module 115. See e.g., FIG. 1 and FIG. 11.

In some embodiments, an interior surface of second side walls 127 of holder 125 may comprise internal-threading 1143 for removable attachment to heat sink module 115. In some embodiments, internal-threading 1143 of holder 125 may complimentary mate with threading 1123 of heat sink module 115 that is located on the bottom portion of heat sink module 115. See e.g., FIG. 11 and FIG. 1.

Figure 12A:
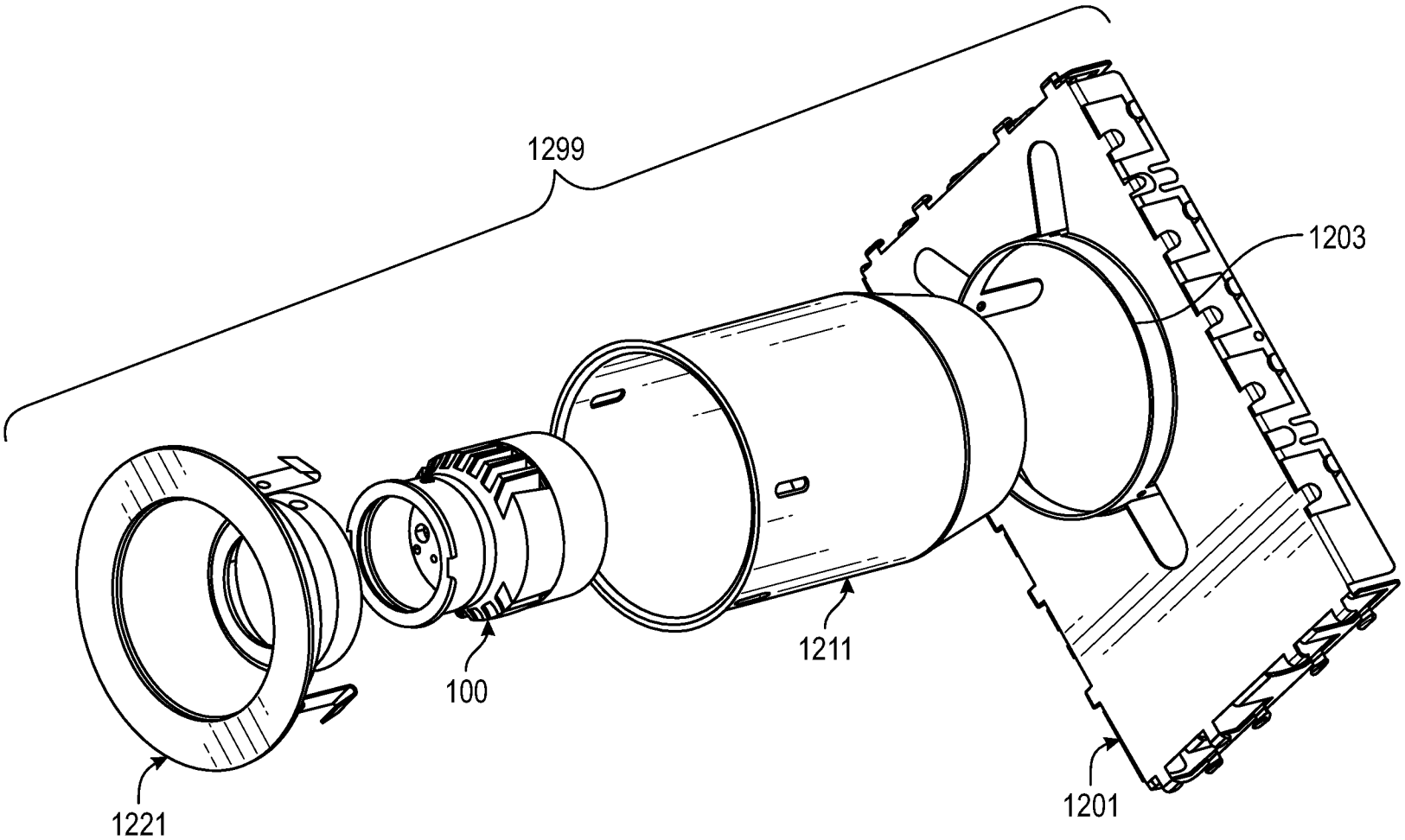
FIG. 12A illustrates an exploded bottom perspective view of the assembled integrated lighting module of FIG. 1 with respect to a frame, a can, and a trim.

FIG. 12A illustrates an exploded bottom perspective view of the assembled integrated lighting module 100 with respect to a frame 1201, a can 1211, and a trim 1221. FIG. 12A may depict an operational environment for the assembled integrated lighting module 100. In some embodiments, the assembled integrated lighting module 100 may be inserted into can 1211. In some embodiments, at least a portion of can 1211 may be fitted into a frame hole 1203, wherein the frame hole 1203 may be hole in frame 1201 for receiving at least a portion of can 1211. In some embodiments, the assembled integrated lighting module 100 (e.g., the twist-lock-teeth 133) may be attached (removably so in some embodiments) to trim 1221. Outer edges of the main flange of trim 1221 may cover over rough ceiling (or wall) holes. In some embodiments, trim 1221 may be of a fixed and predetermined size. In some embodiments, trim 1221 may be a "MR16" standard sized trim as that term may be used in the United States lighting industry. In some embodiments, trim 1221 may be other standard sizes. In some embodiments, FIG. 12A may show full assembly 1299 in an exploded state. In some embodiments, full assembly 1299 may comprise: frame 1201, can 1211, the assembled integrated lighting module 100, and trim 1221. In some embodiments, full assembly 1299 may be a lighting system.

Figure 12B:
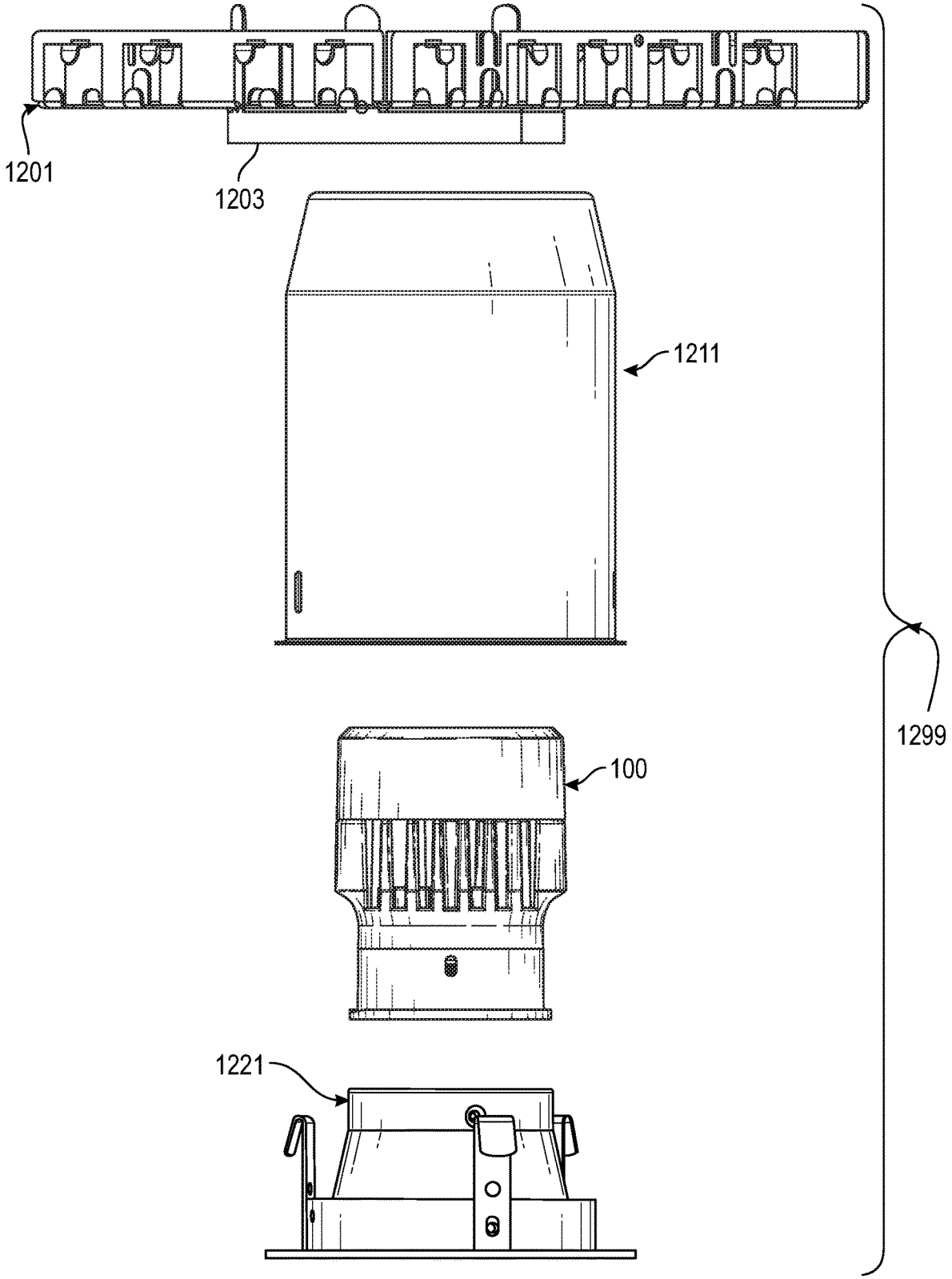
FIG. 12B illustrates an exploded side view (or rear view for view terminology of FIG. 3) of the assembled integrated lighting module of FIG. 1 with respect to the frame, the can, and the trim.

FIG. 12B illustrates an exploded side view (or rear view for view terminology of FIG. 3) of the assembled integrated lighting module 100 with respect to frame 1201, can 1211, and trim 1221. In some embodiments, FIG. 12B may show full assembly 1299 in an exploded state. As noted, in some embodiments, full assembly 1299 may comprise: frame 1201, can 1211, the assembled integrated lighting module 100, and trim 1221.

In some embodiments, a system for lighting may comprise at least one integrated lighting module 100 (e.g., assembled), and one or more of: at least one trim 1221, at least one can 1211, and/or at least one frame 1201.

In some embodiments, the invention may be characterized as a system for lighting. In some embodiments, the system may comprise integrated lighting module 100 and trim 1221. In some embodiments, trim 1221 may be sized as "MR16" which is a standard size of trim in the United States lighting industry. In some embodiments, trim 1221 may be other fixed and predetermined sizes. In some embodiments, the system may further comprise can 1211, wherein integrated lighting module 100 is received substantially within can 1211. In some embodiments, the system may further comprise frame 1201, wherein frame 1201 is configured to hold can 1211; wherein can 1211 is configured to hold the integrated lighting module 100. See e.g., FIG. 12A or FIG. 12B.

In some embodiments, integrated lighting module 100 may be configured to receive 120 V (volts), A/C (alternating current), as an input. In some embodiments, integrated lighting module 100 may be configured to receive 110 V (volts), A/C, as an input. In some embodiments, integrated lighting module 100 may be configured to receive other predetermined voltages as an input.

In some embodiments, integrated lighting module 100 may be used with trim 1221 that may be sized "MR16." In some embodiments, trim 1221 may be another predetermined sized trim. In some embodiments, integrated lighting module 100 may be used with trim 1221 that may have a three inch size; and with adjustability of integrated lighting module 100.

In some embodiments, integrated lighting module 100 may include sufficient space for a driver to be flush with a top of integrated lighting module 100. For example, and without limiting the scope of the present invention, the driver may be located substantially within driver cap 101.

At least some components of integrated lighting module 100 may be 3D (three dimensional) printed, injection molded, cast, stamped, die cast, die cut, extruded, and/or the like.

An integrated lighting module and a system using an integrated lighting module have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An integrated lighting module comprising:

a driver cap that has first side walls, a first top that caps the first side walls, and is open at a first bottom;

wherein the first side walls and the first top substantially surround a first volume of the driver cap, wherein the first volume is configured to receive a driver for powering a light emitting diode chip of the integrated lighting module;

a heat sink module comprising side walls formed of an upper wider portion and a bottom narrower portion, wherein the upper wider portion that has a larger diameter than a diameter of the bottom narrower portion of the heat sink module; wherein the bottom narrower portion transitionally curves into the upper wider portion; wherein the first bottom of the driver cap is attachable to a second top, wherein the second top is a top of the heat sink module; wherein the upper wider portion of the heat sink module comprises a plurality of fins that are configured for dissipating heat, wherein the plurality of fins run substantially in a same linear direction that is substantially parallel with a transverse cross-section of the heat sink module;

the light emitting diode chip that is configured to emit light away from the driver cap;

an optical reflector that is substantially conical in shape for reflecting and directing at least some light from the light emitting diode chip out of a second bottom, wherein the second bottom is a bottom of the optical reflector; wherein the light emitting diode chip is disposed above a top-hole of the optical reflector and within the heat sink module, wherein the top-hole is located at a top of the optical reflector; and a holder that has second side-walls that substantially surround a second volume, wherein the second volume is configured to receive at least a portion of the bottom narrower portion of the heat sink module; wherein the holder is open at a third top, wherein the third top is a top of the holder; wherein the holder attaches to the heat sink module such that the optical reflector is fixed between the holder and the heat sink module, with the top-hole of the optical reflector extending into the bottom narrower portion of the heat sink module;

wherein the upper wider portion of the heat sink module is closer to the driver cap than to the holder.

2. The integrated lighting module according to claim 1, wherein the first top of the driver cap comprises at least one aperture.

3. The integrated lighting module according to claim 1, wherein the first top of the driver cap comprises at least one indicator.

4. The integrated lighting module according to claim 1, wherein a bottom portion of the plurality of fins at least partially extends into the bottom narrower portion of the heat sink module.

5. The integrated lighting module according to claim 1, wherein at least one fin selected from the plurality of fins runs without interruption, across the second top, from one end of the heat sink module to an opposing end of the heat sink module, with respect to a transverse width of the heat sink module.

6. The integrated lighting module according to claim 1, wherein the second top of the heat sink module comprises at least one aperture.

7. The integrated lighting module according to claim 6, wherein the at least one aperture interrupts at least one fin selected from the plurality of fins of the heat sink module.

8. The integrated lighting module according to claim 1, wherein the bottom narrower portion of the heat sink module comprises threading for removable attachment to the holder.

9. The integrated lighting module according to claim 1, wherein the third bottom of the holder comprises two twist-lock-flanges that are configured for removable attachment to a trim, wherein each of the two twist-lock-flanges is a flange.

10. The integrated lighting module according to claim 9, wherein the two twist-lock-flanges are separated from each other by two twist-lock-openings that are breaks between the two twist-lock-flanges.

11. The integrated lighting module according to claim 9, wherein each of the two twist-lock-flanges begins with twist-lock-teeth, wherein the twist-lock-teeth are configured to removably engage at least a portion of the trim.

12. The integrated lighting module according to claim 1, wherein the second side-walls of the holder comprises at least one thread lock notch that is a through hole passing through a portion of the second side-walls, wherein the at least one thread lock notch is configured to receive at least one screw to secure a portion of the optical reflector against the heat sink module.

13. The integrated lighting module according to claim 1, wherein an interior surface of the second side-walls of the holder comprises internal-threading for removable attachment to the heat sink module.

14. The integrated lighting module according to claim 13, wherein the internal-threading of the holder complimentary mates with threading of the heat sink module that is located on the bottom narrower portion of the heat sink module.

15. A system for lighting comprising:

an integrated lighting module, wherein the integrated lighting module comprises:

a driver cap that has first side walls, a first top that caps the first side walls, and is open at a first bottom; wherein the first side walls and the first top substantially surround a first volume of the driver cap, wherein the first volume is configured to receive a driver for powering a light emitting diode chip of the integrated lighting module;

a heat sink module comprising side walls formed of an upper wider portion and a bottom narrower portion, wherein the upper wider portion that has a larger diameter than a diameter of the bottom narrower portion of the heat sink module; wherein the bottom narrower portion transitionally curves into the upper wider portion; wherein the first bottom of the driver cap is attachable to a second top, wherein the second top is a top of the heat sink module; wherein the upper wider portion of the heat sink module comprises a plurality of fins that are configured for dissipating heat, wherein the plurality of fins run substantially in a same linear direction that is substantially parallel with a transverse cross-section of the heat sink module;

the light emitting diode chip that is configured to emit light away from the driver cap;

an optical reflector that is substantially conical in shape for reflecting and directing at least some light from the light emitting diode chip out of a second bottom, wherein the second bottom is a bottom of the optical reflector; wherein the light emitting diode chip is disposed above a top-hole of the optical reflector and within the heat sink module, wherein the top-hole is located at a top of the optical reflector; and a holder that has second side-walls that substantially surround a second volume, wherein the second volume is configured to receive at least a portion of the bottom narrower portion of the heat sink module;

wherein the holder is open at a third top, wherein the third top is a top of the holder; wherein the holder attaches to the heat sink module such that the optical reflector is fixed between the holder and the heat sink module, with the top-hole of the optical reflector extending into the bottom narrower portion of the heat sink module;

wherein the upper wider portion of the heat sink module is closer to the driver cap than to the holder; and a trim, wherein the trim is configured for removable attachment to the holder.

16. The system according to claim 15, wherein the trim is sized as "MR16" which is a standard size of trim in the United States lighting industry.

17. The system according to claim 15, wherein the system further comprises a can, wherein the integrated lighting module is received substantially within the can.

18. The system according to claim 15, wherein the system further comprises a frame, wherein the frame is configured to hold a can; wherein the can is configured to hold the integrated lighting module.

19. The system according to claim 18, wherein the system further comprises the can.

* * * * *